United States Patent [19]

Peterson

[11] Patent Number: 4,538,751

[45] Date of Patent: Sep. 3, 1985

[54] CIGARETTE CASE

[76] Inventor: Robert A. Peterson, 699 Berwood Ave., St. Paul, Minn. 55110

[21] Appl. No.: 520,708

[22] Filed: Aug. 5, 1983

[51] Int. Cl.[3] ..... A45C 11/22; B65D 43/08

[52] U.S. Cl. ..... 224/252; 224/269; 215/227; 220/356

[58] Field of Search ..... 206/37, 38; 220/287, 220/352, 355, 356, 212; 224/252, 269; 81/3.1 C, 3.1 R, 3.1 A, 3.1 D, 177 E; 215/227

[56] References Cited

U.S. PATENT DOCUMENTS

| | | | |
|---|---|---|---|
| 1,466,548 | 8/1923 | Raney . | |
| 1,492,422 | 4/1924 | Carter | 215/227 |
| 1,599,652 | 9/1926 | Cranston . | |
| 2,626,614 | 1/1953 | Hamer . | |
| 2,931,230 | 4/1960 | Lowery | 215/227 |
| 4,190,148 | 2/1980 | Schade, II et al. . | |

*Primary Examiner*—Stephen Marcus
*Assistant Examiner*—David Voorhees
*Attorney, Agent, or Firm*—Cushman, Darby & Cushman

[57] ABSTRACT

A watertight, buoyant container for carrying on the person. An integral body cooperates with a reversible cap adapted to be received by the body to effect watertight closure of a compartment in either of two orientations. A clip is provided extending outwardly from one end of the cap, disposed so that in the first orientation the clip is received in the compartment and, in the second orientation, the clip is operatively exposed for securing the container to an extrinsic object. A tapered compartment configuration to facilitate receiving the clip in the compartment is also disclosed.

3 Claims, 7 Drawing Figures

Fig. 1.
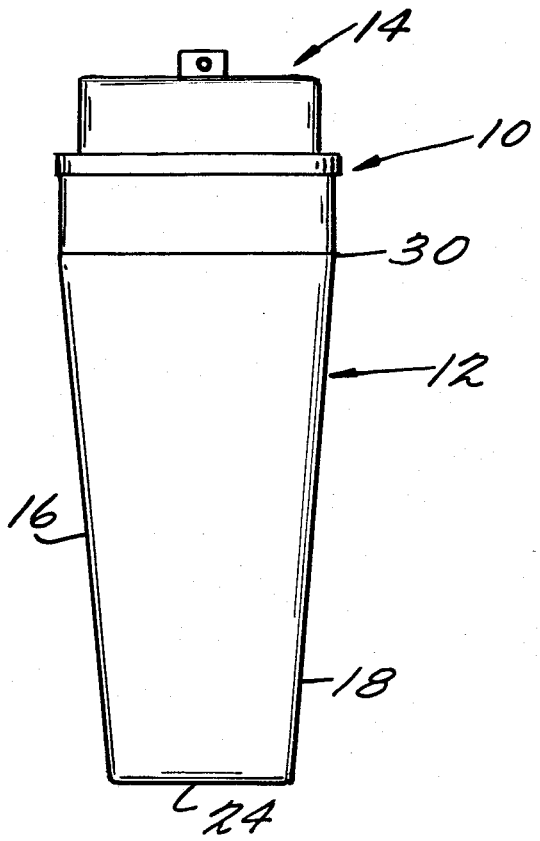
Fig. 2.
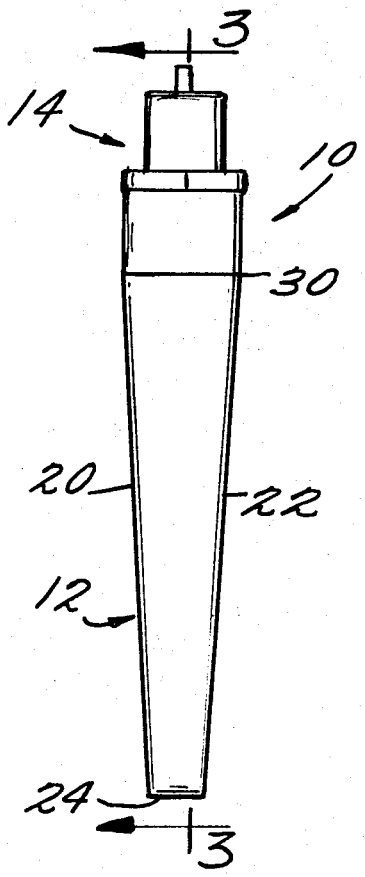
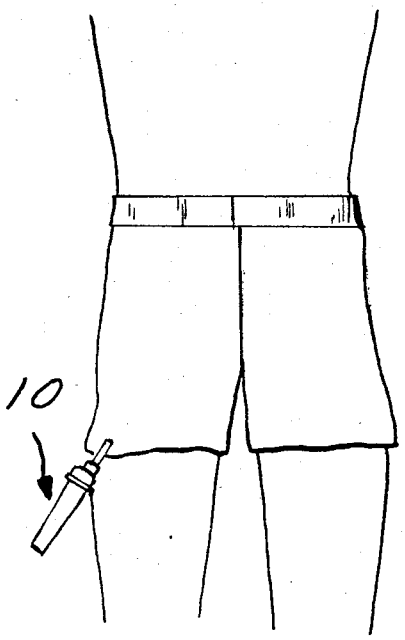
Fig. 7.

CIGARETTE CASE

BACKGROUND OF THE INVENTION

The present invention relates to watertight cases for carrying on the person and, more particularly, to a watertight, lightweight, floatable case for sportsmen, especially adapted for cigarettes.

In general, small waterproof containers for carrying on the person are known. For example, U.S. Pat. No. 1,466,548 (issued to J. L. Raney on Aug. 28, 1923) describes a waterproof container for cigarettes which can be buckled about the wrist, the arm or other portion of the user's body. Similarly, U.S. Pat. No. 1,599,652, issued to A. Cranston on Sept. 14, 1926, describes a small waterproof container including belt loops for facilitating carrying on the person.

Cigarette cases including mechanisms for clipping or securing the case to a garment are also known. Such a case is described in U.S. Pat. No. 4,196,148, issued to P. W. Schade III et al on Feb. 26, 1980.

Another cigarette container (a combined cigarette holder, casing and stand) is described in U.S. Pat. No. 2,626,614 (1953).

The above-described cases all suffer from one or more drawbacks. Known waterproof cases tend to require special flanges and rods, and, accordingly, suffer from, for example, difficulty in or complexity of manufacture and/or use. Other cases tend to be bulky or cumbersome. Yet still others are not comfortably or conveniently securable to either the user's person or clothing. Further, known cases tend not to float on water.

SUMMARY OF THE INVENTION

The present invention provides a lightweight, waterproof and buoyant container, easily and securely attachable to but readily removable from an item of clothing or other object and otherwise readily maintained on the user's person. The container is specially configured to facilitate carrying of cigarettes.

In accordance with one aspect of the present invention, a reversible cap including a clip extending outwardly one end thereof is used in cooperation with an integral body. A waterproof seal is provided by reception of either end of the cap in the body mouth. The clip is disposed for securing the container to an extrinsic object when the cap is in a first position, adapted to be received in the body cavity when the cap is reversed.

In accordance with another aspect of the present invention, the body cavity is tapered to facilitate reception of the clip in the body cavity when the cavity contains other items.

BRIEF DESCRIPTION OF THE DRAWING

A preferred exemplary embodiment will hereinafter be described in conjunction with the appended drawing, wherein like designations denote like elements and:

FIG. 1 is a front view of a container (cap closed), according to the present invention, sealed with the cap in a first orientation;

FIG. 2 is a side view of a container, according to the present invention, sealed with the cap in the first orientation;

FIG. 7, not to scale, shows a cigarette container, according to the present invention, attached to an article of clothing.

DETAILED DESCRIPTION OF THE INVENTION

Figure 6:
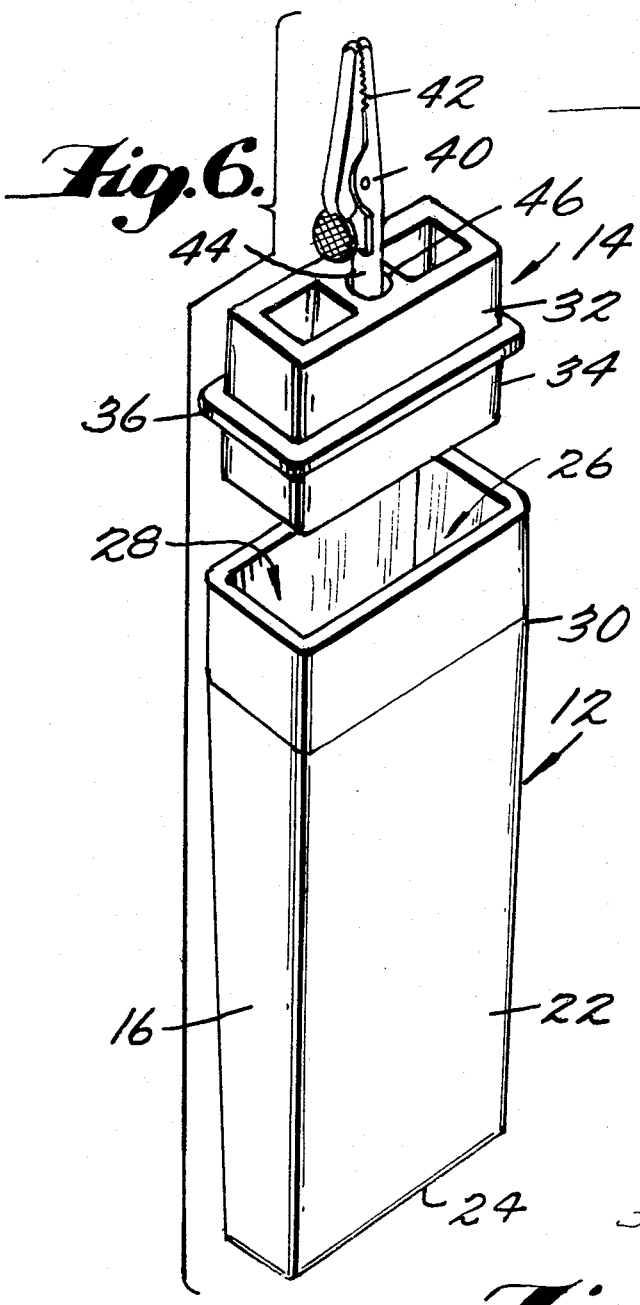
FIG. 6 is a perspective view of a container, in accordance with the present invention, with the cap removed, but disposed in a reversed orientation.

Referring now to FIGS. 1 through 6, a container 10 in accordance with the present invention comprises an integrally formed one piece body 12 and a cooperating reversible cap 14.

Body unit 12 includes respective pairs of opposing sidewalls 16 and 18 (seen in FIGS. 1 and 3) and 20, 22 (best seen in FIG. 2), integrally formed with an end piece 24. Body 12 is suitably formed of a resilient plastic material. Sidewalls 16, 18, 20 and 22, and end piece 24 cooperate to form a cavity (compartment) 26 (best seen at FIGS. 3 and 6) opening at an access port 28. As will hereinafter be explained, body 12 preferably includes at least one pair of opposing sidewalls which taper inwardly from a point 30, a predetermined distance from access port 28, towards end point 24 so that the cross-sectional area of compartment 26 is greater in the vicinity of access port 28 than in the vicinity of end piece 24. Specifically, in the preferred embodiment, each of the opposing pairs of sidewalls 16, 18, and 20, 22 taper inwardly from point 30 to the juncture with end piece 24 (best seen in FIGS. 1, 2, 3, and 5).

Point 30 is suitably chosen in accordance with the configuration of cap 14 and the extent to which cap 14 is received in cavity 26.

By way of example, body 12 is suitably approximately 4 inches in height (as measured from end piece 24 to port 28). The cross-sectional area of compartment 26 at access port 28 is approximately 1.625 inches in length by 0.435 inch in width, and remains constant until a point 30 approximately 0.50 inch from the lip of access port 28. Thereafter the cross section of compartment 26 linearly decreases to approximately 1.250 inches in length, by 0.310 inch in width at end piece 24.

Figure 3:
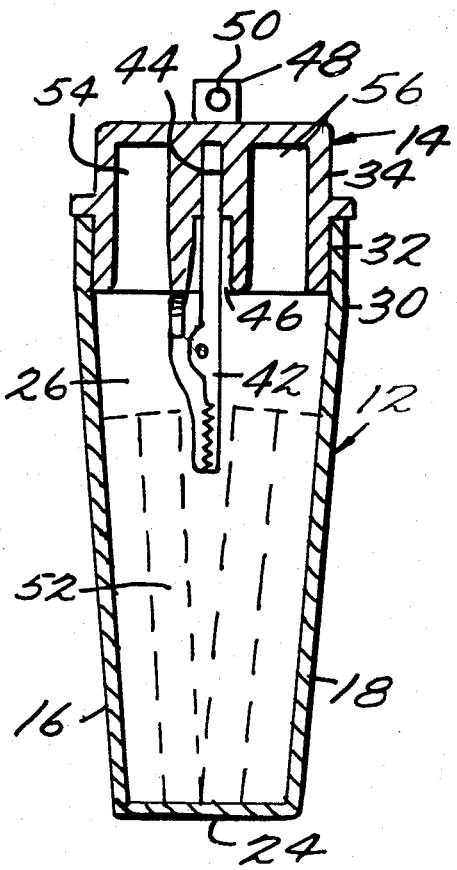
FIG. 3 is a cross section cut away frontal view of a container, according to the present invention, with the cap in the first orientation.
Figure 4:
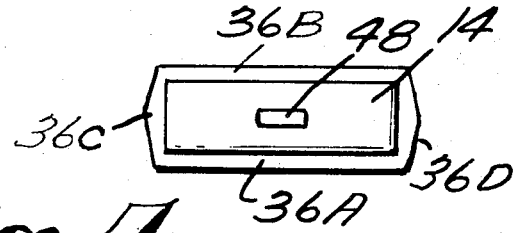
FIG. 4 is a top view of a container, according to the present invention, with the cap in the first orientation.
Figure 5:
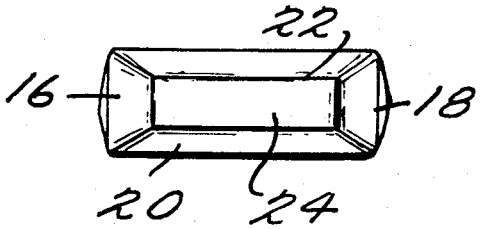
FIG. 5 is a bottom view of a container, according to the present invention.

Reversible cap 14, as best seen in FIGS. 3 and 6, includes first and second end portions 32 and 34, each having peripheral configurations conforming to access port 28 and the portion of compartment 26 in the vicinity of port 28. An outwardly extending peripheral lip or ridge 36 is disposed about the external central periphery of cap 14, at approximately the juncture of end portions 32 and 34. A clip 40 is affixed to first end portion 32 of cap 14, extending outwardly therefrom. Clip 40 is suitably an alligator clip having a jaw portion 42 and a haft portion 44. First end portion 32 of cap 14 suitably includes an axial bore 46 extending therethrough, adapted to receive haft portion 44 of clip 40. Haft 44 of clip 40 suitably includes a terminal portion 48 having a transverse bore 50 extending therethrough (best seen in FIG. 3). Haft 44 is suitably sufficiently long so that jaw portion 42 of the clip operatively clears cap 14, while at the same time terminal portion 48 of haft 44 extends outwardly from end portion 34 of cap 14, sufficiently to permit transverse bore 50 to be accessible. Haft 44 of clip 40 is suitably solid, or at least closed, and is closely received by at least a portion of bore 36 so that the cooperation of clip 40 with cap 14 does not provide any leakage paths through cap 14, and, as will be explained, cap 14 is capable of providing a watertight seal with respect to body 12.

End portions 32 and 34 are of similar dimensions, and each peripherally closely conforms to the shape of access port 28, and a portion of compartment 26. In the specific embodiment described above end portions 32 and 34 are each approximately 1.625 inches in length by 0.435 inch in width (exterior cross section) and 0.50 inch in depth to conform to compartment 26. Thus, each end portion 32 and 34 of cap 14 are adapted to be received in close relation with resilient sidewalls, 16, 18, 20 and 22. Such that ridge 36 comes against the edge of access port 28 (best seen in FIG. 3). Thus when either end portion of cap 14 is received in compartment 26 a secure, watertight mating is provided between the cap end portion 32 or 34 and access port 28. Ridge 36 prevents over-extension of the cap 14 into the cavity and facilitates the formation of a watertight seal. The portions 36A, 36B (best seen in FIG. 4) of ridge 36 that are disposed to cooperate with the edges of sidewalls 20 and 22 extending outwardly from cap 14 a distance substantially equal to the thickness of walls 20 and 22, to provide a relatively streamlined configuration (to facilitate retaining container 10 in, for example, a pocket without "snagging"). The portions, 36C and 36D of ridge 36, adapted to cooperate with the edges of walls 16 and 18, have a peripheral configuration, so that the central portions thereof extend beyond the exterior surface of walls 16 and 18 to facilitate removal of cap 14 from body 12.

Cap 14 is reversible, in the sense that cap 14 can be received in cavity 26 to provide a watertight seal in either of two orientations: a first orientation, such as shown in FIGS. 1, 2, 3, and 4 wherein end portion 32 (and hence clip jaws 42) are received in compartment 26; and a second orientation whereby second end portion 34 is received in cavity 26, and clip jaws 42 are operatively exposed to secure container 10 to some extrinsic object such as a garment.

When cap 14 is received by body 12 in the first orientation, i.e., with clip jaws 42 received by cavity 26, case 10 manifests a sleek, streamlined exterior, to facilitate carrying case 10, in, for example, a pocket or purse, and removal therefrom, without snagging. The reception of clip jaws 42 in compartment 26 is facilitated by the tapered configuration of a compartment 26, described above. Specifically, the cross-sectional area of compartment 26 is varied such that the portion of chamber 26 which receives jaws 42 (at any given elevation) manifests a cross-sectional area greater than the cross-sectional area of the chamber in the vicinity of bottom piece 24 by an amount at least equal to the cross-sectional area of jaws 42 (at the appropriate elevation).

Such a volume gradient is particularly advantageous with respect to the storage of cigarettes or other individual items which are of sufficient length to otherwise interfere with reception of jaws 42 in compartment 26. The narrower cross section of the compartment near bottom piece 24 effectively limits the number of such items that can be stored in the compartment. The greater volume of the compartment in the area receiving jaws 42 permits the items to diverge and ensures that sufficient unoccupied area is provided in the compartment to receive jaws 42. Bottom piece 24, in the preferred embodiment, is dimensioned corresponding to the ends of four adjacently disposed cigarettes 52, shown in FIG. 3.

As previously noted, terminal portion 48 of clip haft 44 extends outwardly from cap 14, and transverse bore 50 is accessible when cap 14 is received by body 12 in this first orientation. Bore 50 is provided to receive, for example, a keyring, or chain. It should be appreciated, however, that haft 40, if desired, can be terminated within the body of cap 14 and an extending terminal portion omitted.

As previously noted, case 12 is designed to float in water. This is particularly important when cap 14 is received in the first orientation, and is thus not necessarily secured to any extrinsic object. In this regard, respective recesses 54 and 56 are provided in cap 14, to decrease the weight of container 10 and increase buoyancy. Recesses 54 and 56 may be in the form of closed air pockets, if desired, but preferably open to the exterior of end portion 32, such that communication with compartment 26 is established when cap 14 is received by body 12 in the first orientation.

When cap 14 is received by body 12 in the second orientation, clip jaws 42 extend outwardly from the container, to selectively secure container 10 to an extrinsic object, such as, for example, a bathing suit or T-shirt or the like, such as shown in FIG. 7. The mating between end portion 34 and body 12 secures body 12 to cap 14 so that body 12 is not disengaged from cap 14 by gravity or minor mishandling.

The use of clip jaws 42 rigidly coupled to a haft 44 (and thus rigidly extending from cap 14) are particularly advantageous for usage by a smoker in wet environs, such as on a boat or beach or by a fisherman, in that clip 40 provides a mechanism for holding a lit cigarette up from wet surfaces, when it is not actively being smoked or held in hand.

It should be appreciated that the present invention provides a particularly advantageous waterproof container that can be maintained on the body. With the cap received by body 12 in the first orientation, the case is easily maintained in a pocket or purse, without danger of snagging other items on the clip. This is facilitated by the streamlined exterior of case 10. Further, the tapered configuration of body 12 ensures that clip 40 can be received in body 12, without damaging, for example, cigarettes contained in the compartment 26. With cap 14 received by the second orientation, case 10 can readily be clipped to an extrinsic object such as a garment or the like.

In addition, particularly with cap 14 in the first orientation, case 10 tends to be buoyant and float on water. Moreover, it should be appreciated that body 12 and cap 14 can easily and relatively inexpensively be fashioned from plastic using standard injection molding techniques.

It will be understood that the foregoing description is of a preferred exemplary embodiment of the present invention, and the invention is not limited to the specific form shown. For example, additional securing mechanisms may be included, for example, cooperating between the exterior of body 12 and ridge 36. Similarly, the dimensions or shape of case 10 or clip 40 can be varied. These and other modifications may be made in the design and arrangement of the elements without departing from the spirit of the invention as expressed in the appended claims.

What I claim is:

1. A portable, waterproof container comprising:

an integral body, including respective sets of sidewalls and a bottom piece, defining a cavity therein having an opening at one end of said body wherein at least one said set of integral body opposing sidewalls taper inwardly from a predetermined point with respect to said opening to said bottom piece such that the cross-sectional area of said cavity is greater near said opening than near said bottom piece by a predetermined difference in cross-sectional area; and a reversible cap including first and second end portions, each conforming to said opening and a predetermined portion of said cavity, wherein said cap first end portion includes an axially disposed bore, said bore communicates between said cap first and second portions;

an outwardly extending lip disposed about the periphery of said cap at the junction of said end portions, said first and second end portions being adapted to be received in said opening such that said lip is adjacent to said sidewalls about the lip of said opening, said lip, sidewalls, and cap cooperating to effect a watertight seal between said cap and said body; and alligator clip means, affixed to said first end portion and extending generally axially outward therefrom, for effecting selective fastening to an extrinsic object, said clip means being adapted to be received in said cavity when said first end portion is inserted and received in said opening, said clip means includes a haft portion adapted to be fixedly received in said bore, wherein said haft portion extends through said bore and includes a terminal portion extending outwardly from said cap second end portion, said clip means haft terminal portion includes a transverse bore therethrough.

2. The container of claim 1 wherein said container is buoyant when said cap effects said watertight seal.

3. The container of claim 1 wherein said cap incldes at least one recess disposed to increase buoyancy when said cap first end portion is received in said opening.

* * * * *